US005119637A

United States Patent [19]

Bard et al.

[11] Patent Number: 5,119,637

[45] Date of Patent: Jun. 9, 1992

[54] ULTRA-HIGH TEMPERATURE STABILITY JOULE-THOMSON COOLER WITH CAPABILITY TO ACCOMMODATE PRESSURE VARIATIONS

[75] Inventors: Steven Bard, Northridge; Jiunn-Jeng Wu, Sierra Madre; Curtis A. Trimble, Sierra Madre, all of Calif.

[73] Assignee: The United States of America as represented by the Administrator of the National Aeronautics and Space Administration, Washington, D.C.

[21] Appl. No.: 636,076

[22] Filed: Dec. 28, 1990

[51] Int. Cl.[5] ..... F25B 19/02

[52] U.S. Cl. ..... 62/51.2; 62/224

[58] Field of Search ..... 62/51.2, 224; 165/30

[56] References Cited

U.S. PATENT DOCUMENTS

| | | | |
|---|---|---|---|
| 3,293,877 | 12/1966 | Barnes | 62/224 |
| 4,080,802 | 3/1978 | Annable | 62/51.2 |
| 4,126,017 | 11/1978 | Butniewski et al. | 62/51.2 |
| 4,761,556 | 8/1988 | Simpson et al. | 62/51.2 |
| 5,060,481 | 10/1991 | Bartlett et al. | 62/51.2 |

*Primary Examiner*—Ronald C. Capossela

*Attorney, Agent, or Firm*—Thomas H. Jones; John R. Manning; Guy M. Miller

[57] ABSTRACT

A Joule-Thomson cryogenic refrigeration system capable of achieving nigh temperature stabilities in the presence of varying temperature, atmospheric pressure, and heat load is provided. The Joule-Thomson cryogenic refrigeration system includes a demand-flow Joule-Thomson expansion valve disposed in a cryostat of the refrigeration system. The expansion valve has an adjustable orifice that controls the flow of compressed gas therethrough and induces cooling and partial liquefaction of the gas. A recuperative heat exchanger is disposed in the cryostat and coupled to the expansion valve. A thermostatically self-regulating mechanism is disposed in the cryostat and coupled to the J-T expansion valve. The thermostatically self-regulating mechanism automatically adjusts the cross-sectional area of the adjustable valve orifice in response to environmental temperature changes and changes in power dissipated at a cold head. A temperature sensing and adjusting mechanism is coupled to the cold head for adjusting the temperature of the cold head in response to the change in heat flow in the cold head. The temperature sensing and adjusting mechanism comprises a temperature sensitive diode, a wound wire heater, and an electrical feedback control circuit coupling the diode to the heater. An absolute pressure relief valve is interposed between the output of the cryostat and an exhaust port for maintaining a constant exhaust temperature of the refrigeration system, independent of changes in atmospheric pressure.

12 Claims, 2 Drawing Sheets

ULTRA-HIGH TEMPERATURE STABILITY JOULE-THOMSON COOLER WITH CAPABILITY TO ACCOMMODATE PRESSURE VARIATIONS

ORIGIN OF THE INVENTION

The invention described herein was made in the performance of work under a NASA contract, and is subject to the provisions of Public Law 96-517 (35 U.S.C. Section 202) in which the Contractor has elected not to retain title.

TECHNICAL FIELD

The subject invention relates generally to a Joule-Thomson cryogenic refrigeration system and, more particularly, to a Joule-Thomson cooler that is able to operate at substantially stable temperatures in the presence of varying temperature, atmospheric pressure, and heat load.

BACKGROUND ART

One of the problems associated with Joule-Thomson coolers is their inability to achieve temperature stabilities of less than 1° K. per minute in the presence of a varying temperature, environmental pressure, and heat loads.

Prior art Joule-Thomson (J-T) coolers, particularly of the high efficiency miniature "demand-flow" type, have been used for more than 20 years to cool infrared (IR) detectors and other temperature-sensitive instruments in a multiplicity of military, commercial, and scientific applications. These J-T coolers are ideal for a relatively short duration, e.g., less than 10 hours, in applications such as missile, infrared guidance sensors, and instruments on scientific balloon flights. The temperature achieved by these coolers is directly related to the pressure at which the gas is exhausted from the device. If the exhaust ambient pressure varies, for example, due to atmospheric pressure variations which occur due to altitude changes in a missile or balloon flight, then the cooling temperature will also vary accordingly. In addition, while demand-flow J-T valves are able to accommodate variations in heat load, for example, due to varying the power dissipation of the device being cooled, or a changing parasitic heat leak due to a varying environmental temperature, temperature fluctuations of about 1° to 5° K. are still common.

Ultra-high temperature stabilities are required for many applications. Some of these applications include solid state tunable diode lasers (TDLs), whose output frequencies are extremely sensitive to temperature. TDLs require temperature stabilities on the order of 0.1 mK per minute or better.

TDLs are often flown on earth balloon flights as integral parts of infrared spectrometers which monitor constituents in the atmosphere. In typical laboratory and earth balloon flight applications, TDLs must be cooled to between 80° K. and 90° K. to operate effectively and are cooled by immersion of a cold finger into a large liquid nitrogen dewar. These systems are large and heavy, and the cost of refilling the liquid nitrogen is considerable.

The cooler size and mass can be reduced considerably, and the liquid nitrogen cost eliminated completely, by using a miniature J-T blow-down system which requires only a relatively small tank of room temperature gaseous nitrogen, instead of a dewar of liquid nitrogen. However, the problem with conventional J-T systems is their inability to achieve the required temperature stability.

An example of a cryogenic refrigeration system is disclosed in U.S. Pat. No. 3,728,868 by Longsworth. Longsworth discloses a cryogenic refrigeration system having a low thermal mass cryostat coupled to a sensing element which controls a valve that, in turn, regulates fluid flow through a J-T orifice. The sensing element is interposed between a warm end of the cryostat and the J-T orifice. The level of liquid in the system rises to a location near the cold extremity of the sensing element, and this level is the operative control condition. Variations in fluid level about this point adjust for changes in gas pressure, ambient temperature, heat load, and working fluid.

The Hingst U.S. Pat. No. 4,819,451, discloses a countercurrent heat exchanger located in a forward flow conduit in a dewar vessel located in a cryostatic device, used for cooling an infrared detector, based on the J-T effect. To reduce the heat load of an infrared detector, an insulating layer is arranged between the dewar vessel and a base. The cooling power of the J-T process is improved upon by having an inlet of the forward flow conduit cooled by Peltier elements. Other pertinent U.S. Pats. are U.S. Pat. No. 4,570,457, by Campbell; U.S. Pat. No. 4,606,201, by Longsworth; U.S. Pat. No. 4,569,210, by Albangnac; and U.S. Pat. No. 4,468,935, by Albangnac.

As can be appreciated, there exists a need for an improved J-T cooler that is able to operate at stable temperatures in the presence of varying temperature, atmospheric pressure, and heat loads.

STATEMENT OF THE INVENTION

It is therefore an object of the present invention to provide an improved Joule-Thomson cooling system;

It is another object of the invention to provide a Joule-Thomson cooling system that is capable of achieving temperature variations of less than 1 mK per minute;

It is a further object of the invention to provide a Joule-Thomson cooling system that is capable of achieving stable temperatures in the presence of varying temperature, atmospheric pressure, and heat load;

It is still another object of the invention to provide a Joule-Thomson cooling system that does not require a large cryogen gas source.

It is yet a further object of the invention to provide a Joule-Thomson cooler having a cryostat of reduced size and mass.

These and other objects and advantages of the present invention are achieved by providing a Joule-Thomson cooler of an improved design. The improved Joule-Thomson cooler has an absolute pressure relief valve coupled to the exhaust port of a J-T cryostat to accommodate environmental pressure variations which would cause the cold end temperature to vary in conventional J-T coolers. The J-T cryostat includes a feedback control heater that allows fine temperature adjustment capability. The J-T cooler uses a "demand-flow" J-T cryostat having an externally adjustable J-T valve with an adjustable orifice. The J-T orifice is allowed to be set to accurately match the highest heat load and flow rate expected. A J-T cooler incorporating the above features has been built and tested and has successfully demonstrated a temperature stability of less than 0.10 mK degrees per minute.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings.

DETAILED DESCRIPTION OF THE INVENTION

The following description is provided to enable any person in the art to make and use the invention, and sets forth the best modes contemplated by the inventor of carrying out their invention. Various modifications, however, will remain readily apparent to those skilled in these arts.

Figure 1:
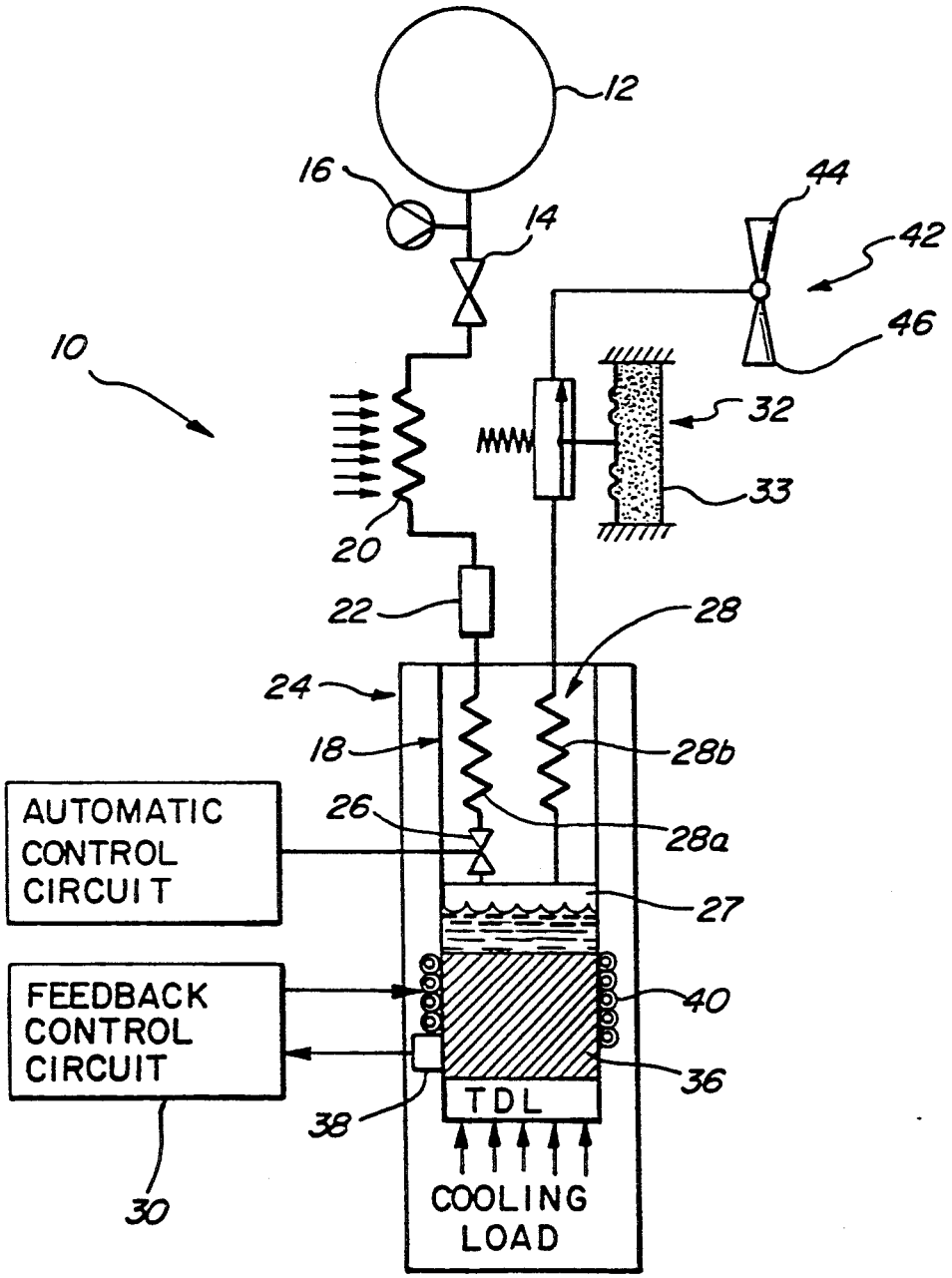
FIG. 1 is a schematic drawing of a preferred embodiment of the present invention, showing a functional application of the present invention.

With reference to FIG. 1, there is shown a functional schematic diagram of a Joule-Thomson cryogenic refrigeration system 10 constructed according to the principles of the present invention. A storage tank 12 is adapted to hold 0.5 liter of a desired compressed gas as the cooling agent. Various gasses such as nitrogen, argon, neon, and methane gas may be used, depending upon the particular cooling temperature the system 10 is required to achieve. The storage tank 12 stores the gas at a nominal pressure of approximately 41400 kPa (6,000 psia).

A miniature valve 14, that may be actuated pyrotechnically or by solenoid, is coupled to an output of the storage tank 12 and is used to initiate the flow of gas, such as nitrogen, from the storage tank 12. The miniature valve 14 used comprises a hermetically sealed system having either an explosive charge in the miniature valve 14 (Pyrotechnic), a solenoid actuator, or a manual actuator. When the valve 14 is opened, the nitrogen gas begins to flow from the tank 12. A fill port 16 is coupled to the nitrogen gas storage tank 12 and to the miniature valve 14. The fill port 16 is used for dispensing nitrogen gas into the storage tank 12.

The miniature valve 14 is coupled to an atmospheric precooling tubing 20, an adsorber 22, and a vacuum dewar 24. The atmospheric precooling tubing 20 may comprise approximately 72.2 centimeters (30 inches) of 1.02 millimeter (0.040 inch) OD coiled stainless steel tubing, for example. The precooling tubing 20 is coupled to the adsorber 22, which essentially comprises a tube filled with dry porous material that adsorbs such potential contaminants in the compressed gas as water and carbon dioxide.

The adsorber 22 is coupled to the vacuum dewar 24. The vacuum dewar 24 may comprise a thin metal inner wall 58 that has been sealed to an outer metal wall 60 (shown in FIG. 3). The vacuum dewar 24 may be constructed from such metals as titanium, aluminum or stainless steel, using principles well known in the art.

When high pressure compressed gas flows from the storage tank 12 it is convectively cooled by the precooling system 20, which is exposed to the atmosphere. The gas taken passes through the adsorber 22 to remove any impurities from the gas before it enters the vacuum dewar 24.

Attached to the vacuum dewar 24 is a J-T cryostat 18 having a "demand-flow" configuration, to be discussed more thoroughly below. The J-T cryostat 18 includes a recuperative heat exchanger 28, a partially liquefied gas reservoir 27, and a Joule-Thomson expansion valve 26.

An input section **28*a* of the heat exchanger 28 transfers gas exiting from the adsorber 22 to the J-T expansion valve 26. The fluid exiting the J-T valve 26 is partially liquid and partially vapor as it flows into the reservoir 27. An output section 28*b* of the heat exchanger 28 transfers gaseous vapor from the reservoir 27 to an absolute pressure relief valve 32. The output section 28*b* is mechanically and thermally connected to the input section 28*a* to precool the gas flowing through the input section 28*a***.

Figures 2, 3:
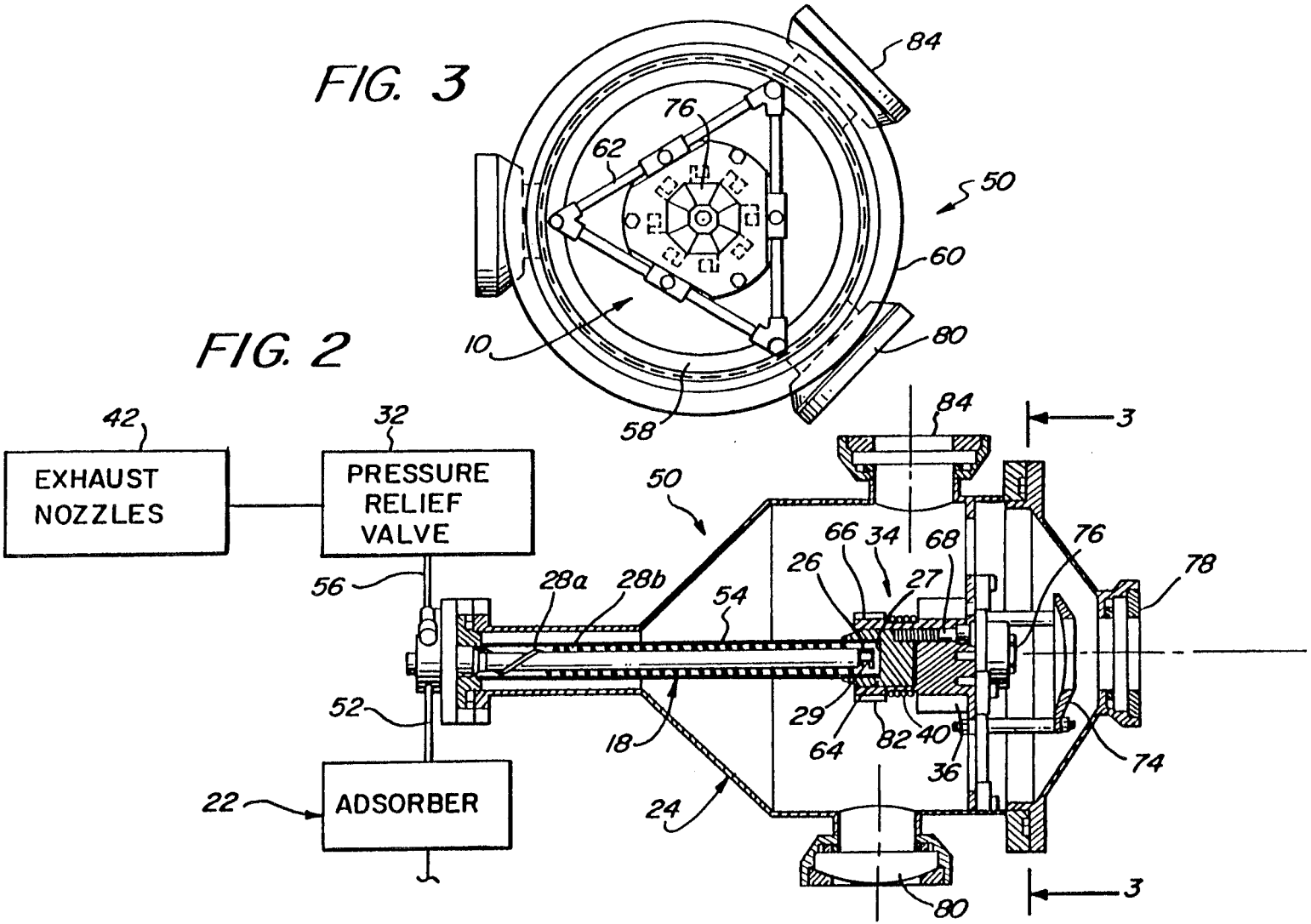
FIG. 2 is a block diagram and schematic drawing of the preferred embodiment showing the present invention in a complete system.
FIG. 3 is a cross sectional view of a mounting apparatus that may be used with the preferred embodiment.

As shown in FIG. 2, the J-T valve 26 may be externally adjustable, which would allow a J-T orifice 29 to be set to accurately match the highest heat load and compressed gas flow rate expected in the use of the cryogenic system 10. The J-T valve 26 is disposed in an extremely small cavity that acts as the reservoir 27 in a cold head block 34 that is coupled to a device to be cooled 36, such as tunable diode laser (TDL), for example.

A temperature sensor 38, comprising a temperature sensitive silicon diode, for example, may be mounted on the cold head block 34 for sensing changes in cold head block 34 temperature and heat load. A heater 40, that may comprise a length of wire having a desired resistance, may be wound around the cold head block 34, for heating the block 34. When a change in temperature of the cold head block 34 is sensed by the sensor 38, an electrical feedback control circuit 30, as is well known in the art, is used to actuate the heater 40.

The absolute pressure relief valve 32 comprises a pressure exhaust valve adapted to sense and maintain a constant exhaust pressure despite a varying ambient pressure. The pressure valve 32 may have a pressurized bellows 33 disposed therein, instead of a spring as is often used. The pressure of the pressurized bellows compensates for changes in the atmospheric pressure and maintains a constant exhaust pressure of approximately 155 kPa (22.5 psia) independent of the atmospheric pressure.

Coupled to the absolute pressure relief valve 32 is an exhaust port 42. The exhaust port 42 may have a pair of opposed exhaust nozzles 44, 46 that are designed to minimize any torque or unbalancing forces that the system 10 exhaust may cause if the system 10 is mounted on a probe, such as a deep space probe or earth flight weather balloon, for example.

In operation, the cryostat 18 receives the precooled gas from the adsorber 22. The heat exchanger's input section **28*a* further cools the gas before isenthalpicly expanding through the adjustable J-T valve 26, that is essentially an orifice. The isenthalpic expansion causes a decrease in temperature and partial liquefaction of the compressed gas. The partially liquid gas is vaporized by the combined heat load from the power dissipated by the cooled device 36 and other parasitic heat leaks, discussed in reference to FIG. 2. After use, gaseous vapor is transferred through the heat exchanger's output section 28*b***, through the absolute pressure relief valve 32, and exhausted into the atmosphere through the exhaust port 42.

The temperature of the liquid gas produced by the J-T valve 26 is equal to the saturation temperature corresponding to the exhaust pressure. For example, the system 10 may be used in an atmosphere where the atmospheric pressure varies from 0.14 to 150 kPa (0.02 psia to 21.8 psia). Because of this atmospheric pressure variance, the temperature of the compressed gas would vary between 63° K. to 81° K. if the gas were alloted to exhaust directly to the atmosphere. The absolute pressure relief valve 32 maintains a constant exhaust pressure of 155 kPa (22.5 psia), independent of the atmospheric pressure. This pressure corresponds to a liquid gas temperature of 82° K.

Referring to FIGS. 2 and 3, there is shown a schematic diagram drawing of Probe Infrared Laser Spectrometer (PIRLS) 50 incorporating the invented demand flow Joule-Thomson cryogenic refrigeration system 10. The adsorber 22 couples to the cryostat 18, through a portion of metal input tubing 52.

The heat exchanger 28 is encompassed by a J-T sleeve 54 that may comprise stainless steel. The heat exchanger's input section 28*a* comprises input tubing that couples to a portion of metal input tubing 52, winds along the cryostat 18, and couples to the J-T valve 26. The heat exchanger's output section 28*b* comprises a small space interposed between the inner periphery of the J-T sleeve 54 and wound input section 28*a*. The input section 28*a* passes compressed gas exiting the metal input tubing 52 along the cryostat 18 to the J-T valve 26. The output section 28*b* transfers gaseous vapors from the J-T valve 26, along the input section 28*a*, to a metal output tubing 56 coupled to the cryostat 18. As compressed gas is flowing through the input section 28*a* to the J-T valve 26, gaseous vapors are exiting through the output section 28*b* along input section 28*a*, to cool and partially liquefy the gas flowing through the input section 28*a*.

The vacuum dewar 24 may be cylindrical and, as shown in FIG. 3, can have its inner wall 58 sealed to an outer wall 60. The dewar 24 may be constructed of titanium, stainless steel, or aluminum for example.

The cold head block 34 can be formed of aluminum or copper and is supported from the dewar 24 by the low thermal conductance stainless steel J-T sleeve 54 and a fiberglass "delta" configuration mount 62, shown in FIG. 3. The J-T sleeve 54 and delta mount 62 are designed to minimize parasitic heat leaks to the cooled device 36, which may be a tunable diode laser, and the cold head block 34. The delta mount 62 connects to the inner wall 58 and is a mechanical stabilizer that gives lateral support to the cold head 34 and TDL 36, while conducting only a small amount of heat because of its low thermal conductivity.

The cold head block 34 essentially comprises a boot 64 of copper, for example, and a cold head 66 of aluminum. The boot 64 is brazed onto the tip of the J-T sleeve 54. The boot is affixed to the cold head 66 which bolts 68. Belleville-type spring washers may be used to prevent the bolts 68 from vibrating loose. High thermal conductance gaskets, comprising indium, for example, are interposed between the boot 64 and cold head 66. The indium gaskets are used to maintain high thermal contact conductance, while accommodating the disparate thermal expansion of the different materials used in the cold head block 34 and TDL 36.

The reservoir 27 is disposed within the boot member 64 for receiving the J-T expansion valve 26. The cross-sectional area of the J-T valve's orifice 29 can be set to accurately match the highest heat load and compressed gas flow rate expected due to environmental temperature changes, and changes in power dissipated at the cold head block 34.

The cold head block 34 may have a total mass of approximately 24.1 grams, for example. The boot 64 may comprise substantially 14.5 grams of copper and the cold head 66 may comprise approximately 9.6 grams of aluminum, for example.

The cooling system 10 incorporates active temperature control of the cold head block 34, to accommodate heat flow variations caused by ambient temperature changes and the continuous switching on and off of different cooled devices 36. This active control is achieved by a temperature sensing and adjusting circuit comprising the small resistance heater 40 disposed on the cold head 66, the temperature sensitive silicon diode 38 (see FIG. 1) mounted on the cold head 66, and electrical feedback controlled circuit 30. The small heater 40 is capable of supplying about 500 milliwatts of power dissipation.

In the PIRLS spectrometer 50 shown, the cooled device 36 comprises a tunable diode laser (TDL) whose frequency output may be altered by altering the amount of current through the laser. A light beam is emitted from the TDL 36 into a spherical collimating mirror 74 and reflector 76, and through a laser port 78. In this application, the spherical collimator mirror 74 and reflector 76 can be formed of aluminum, and are constructed as an integral part of the cold head block 34. The laser port 78 may comprise a zinc selinide window.

A detector port 80 passes light from the TDL 36, after the light beam has passed through absorption cells (not shown), through the dewar 24, onto a detector 82. The detector 82 monitors the light beam emitted by the TDL 36. A reference cell port 84, may be used to pass a back light beam that may be emitted from the TDL 36, through an alternative absorption cell (not shown) to ensure that the TDL 36 is operative.

With reference to FIGS. 1 and 2, the invented J-T cooling system 10 may be mounted, for example, on a space probe or earth weather balloon. The storage tank 12, absolute pressure relief valve 32, and exhaust port 42 may be conductively coupled to the probe to keep them warm through the atmosphere. The precooling tubing 20, adsorber 16, and vacuum dewar 24 are all conductively isolated from the probe with the use of low conductance standoffs, for example. A gas exhaust tubing (not shown) may be wrapped around and attached to the outer dewar wall in order to allow the cold exhaust gas to cool the dewar 24, thereby reducing the various parasitic heat leaks.

A breadboard cooling system, similar to the PIRLS J-T cooling system 50, was tested to show that it was capable of achieving a required ±0.05 mK/20 second temperature stability requirement. The most accurate method of measuring the PIRLS system 10 temperature stability is to examine the drift of an absorption spectrum produced by passing a beam of the TDL 36 through a gas sample, such as a sample cell containing methane gas. The TDL 36 will operate at a wavelength of approximately 7.5 microns in a spectral region where methane absorption lines exist.

A cryodiode mounted on the cold head block 34 has a temperature response with a 10 microamp bias current of about 2 mV/K. A commercial TDL 36 current supply and cryogenic temperature stabilization (CTS) unit were used to bias the TDL 36 and actively stabilize the cold head block 34.

Three tests were performed on the PIRLS J-T cooling system 10, the first of which was to measure the temperature stability of the J-T cooler 10 without the cryogenic temperature stabilization unit, but with the absolute pressure relief valve 32 in place. After cool-down and the achievemert of temperature stability, three methane gas absorption lines were identified to use as a reference. Three frequency scans were taken, with 20-minute intervals between each. For each scan, the TDL 36 start current and current ramp rate were identical. Each scan took approximately 30 seconds from start to finish. A fabry-perot etalon replaced the gas sample for a fourth and last scan to give an absolute frequency scale for calibration.

The tests showed the mean drift rate between the scans to be 31 MHz per minute. The etalon fringe spacing was 0.01625 $cm^{-1}/K$. Assuming a typical temperature tuning rate of 4 $cm^{-1}/K$., this corresponds to a 0.26 mK/min. drift rate.

A second test was performed to determine if the long term stability of the invented system 10 could be improved using the cryogenic temperature stabilization unit. A temperature slightly higher than the J-T set point, about 0.7 Kelvin, was used to allow proper functioning of a CTS control loop. A new set of three methane lines was located, and two scans were taken 30 minutes apart, with a scan time of 60 seconds. A mean drift rate between scans was measured to be 7 MHz per minute or 0.06 mK per minute. Line width was again measured to be about 170 MHz, or essentially the same as with the CTS off. A drift rate of less than 0.10 mK per minute was demonstrated, which is substantially more stable than prior art Joule-Thomson cooling systems.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

We claim:

1. An improved Joule-Thomson cryogenic refrigeration system having a cold head and a cryostat assembly connected to a source of compressed gas, comprising:

an adjustable expansion valve means for adjusting a flow of compressed gas therethrough, the adjustable expansion valve mean having a demand-flow expansion valve with an adjustable orifice, the adjustable valve being affixed to the cryostat assembly, the cross-sectional size of the adjustable orifice being automatically adjusted to any of a range of sizes during operation in response to temperature changes in the proximity of the valve;

a temperature sensing and adjusting means for adjusting he temperature of the cold head in response to changes in heat flow to the cold head; and an absolute pressure valve means, connected to exhaust side of the valve expansion means, for maintaining a constant exhaust pressure of the system independent of changes in ambient atmospheric pressure.

2. The cryogenic refrigeration system of claim 1 wherein the temperature sensing and adjusting means comprises a feedback controlled electrical resistance heater and a temperature sensor disposed on the cold head for automatically adjusting the cold head heat load and temperature.

3. The cryogenic refrigeration system of claim 2 wherein the temperature sensing and adjusting means comprises a temperature sensitive silicon diode and a wound wire resistance heater coupled together by an electrical feedback control circuit.

4. The cryogenic refrigeration system of claim 1 wherein the absolute pressure relief valve means comprises an exhaust valve adapted to sense and maintain a constant exhaust pressure for the system exhaust into varying ambient pressure.

5. The cryogenic refrigeration system of claim 4 wherein the absolute pressure relief valve comprises a pressurized exhaust valve having a pressurized bellows disposed therein, the pressurized bellows compensating for changes in atmospheric pressure to maintain a constant exhaust pressure for the system independent of changes in atmospheric pressure.

6. The cryogenic refrigeration system of claim 5 wherein the compressed gas comprises any suitable gaseous substance capable of being cooled by Joule-Thomson expansion such as Ar, Kr, Ne, $H_2$, $CH_4$, and Xe and gas mixtures thereof.

7. The cryogenic refrigeration system of claim 6 wherein the compressed gas is nitrogen.

8. The cryogenic refrigeration system of claim 6 wherein the compressed gas is neon gas.

9. In a Joule-Thomson cryogenic refrigeration system comprising a compressed gas storage tank, a precooling system coupled to the storage tank, an adsorber coupled to the precooling system, a vacuum dewar, and an exhaust port, the improvement comprising:

a heat exchanger having an input connected to the adsorber and having an output coupled to the exhaust port, the heat exchanger cooling the gas received from the precooling system through the adsorber;

a demand-flow Joule-Thomson cryostat disposed in the dewar and connected to the heat exchanger and a cold head, the cryostat having an adjustable Joule-Thomson expansion valve disposed therein with an adjustable orifice for adjusting the flow of compressed gas and inducing cooling and partial liquefaction of the gas flowing therethrough, a cross-sectional size of the orifice being automatically adjusted to any of a range of sizes during operation in response to temperature changes in the proximity of the valve to regulate the flow of compressed gas flowing therethrough;

a temperature sensing and adjusting mechanism coupled to the cold head for adjusting the temperature of the cold head in response to any changes in heat flow in the cold head, the temperature sensing and adjusting mechanism comprising a temperature sensor, a heater, and a control circuit coupling the sensor to the heater, and an absolute pressure relief valve connected between the heat exchanger output and the exhaust port, the absolute pressure relief valve including a pressurized bellows disposed therein for compensating for changes in atmospheric pressure to maintain a constant exhaust pressure of the refrigeration system, independent of changes in ambient atmospheric pressure.

10. The cryogenic refrigeration system of claim 1, further including manual adjustment means for presetting the minimum size of the orifice of the adjustable expansion valve to correspond to a selected minimum flow rate expected during operation.

11. The cooling apparatus of claim 9 further comprising a tunable diode laser coupled to the cold head.

12. The cooling apparatus of claim 9 wherein the sensor is a temperature sensitive silicon diode sensor.

* * * * *